US006588311B2

(12) United States Patent
Grange et al.

(10) Patent No.: US 6,588,311 B2
(45) Date of Patent: Jul. 8, 2003

(54) AUTOMATIC LOADING DEVICE FOR A WEAPON MOUNTED ON A TURRET

(75) Inventors: Gilles Grange, La Fouilleuse (FR); Yves Martinez, Saint-Chamond (FR); Jean-Philippe Delaire, Saint-Rémy les Chevreuses (FR); Joël Roche, Saint-Etienne (FR); Claude Avrard, Saint-Etienne (FR)

(73) Assignee: GIAT Industries (FR)

( * ) Notice: Subject to any disclaimer, the term of this patent is extended or adjusted under 35 U.S.C. 154(b) by 0 days.

(21) Appl. No.: 10/116,106

(22) Filed: Apr. 5, 2002

(65) Prior Publication Data

US 2002/0144589 A1 Oct. 10, 2002

(30) Foreign Application Priority Data

Apr. 6, 2001 (FR) ..... 01 04684

(51) Int. Cl.[7] ..... F41A 9/11

(52) U.S. Cl. ..... 89/45; 89/46; 89/47; 89/1.804; 89/1.805

(58) Field of Search ..... 89/45, 46, 47, 89/1.804, 1.805, 33.01

(56) References Cited

U.S. PATENT DOCUMENTS

| | | | | | |
|---|---|---|---|---|---|
| 3,106,866 | A | * | 10/1963 | Klapdohr et al. | 89/45 |
| 4,398,447 | A | * | 8/1983 | Harris et al. | 89/46 |
| 4,840,110 | A | * | 6/1989 | Fischer | 89/46 |
| 4,860,633 | A | * | 8/1989 | Wiethoff et al. | 89/45 |
| 5,131,316 | A | * | 7/1992 | Lawrence et al. | 89/46 |
| 5,261,310 | A | * | 11/1993 | Sullivan et al. | 89/46 |
| 6,026,729 | A | * | 2/2000 | Hallqvist | 89/46 |
| 6,481,328 | B1 | * | 11/2002 | Hallqvist | 89/46 |

FOREIGN PATENT DOCUMENTS

| | | | | |
|---|---|---|---|---|
| DE | 3631-796 A | * | 4/1987 | 89/45 |
| EP | 0569 342 A1 | | 11/1993 | |
| EP | 569342 A1 | * | 11/1993 | F41A/9/14 |
| FR | 966 693 A | | 10/1950 | |

* cited by examiner

*Primary Examiner*—Michael J. Carone
*Assistant Examiner*—Gabriel S. Sukman
(74) *Attorney, Agent, or Firm*—Parkhurst & Wendel, L.L.P.

(57) ABSTRACT

The invention relates to a loading device for a medium or large caliber weapon supplied with rounds constituted by a projectile and modular charges.

It comprises means to receive a projectile and modular charges, a vehicle incorporating at least two housings and suitable support means to allow the vehicle to move from a starting replenishing position to a final weapon loading position in which the projectile housing then the modular charge housing are successively brought into said position. The support means are constituted by a cage having two sides between which the vehicle travels. The vehicle is constituted by a slide and a drum provided with housings at its parallel edges each intended to receive a container.

Application of 155 mm 52 caliber weapons.

13 Claims, 3 Drawing Sheets

AUTOMATIC LOADING DEVICE FOR A WEAPON MOUNTED ON A TURRET

BACKGROUND OF THE INVENTION

The technical scope of the present invention is that of feed devices for a weapon.

To feed a large or medium caliber weapon (for example 100 to 155 mm), it is well known to use either manual loading using a tray and in which case it is possible for single rounds or two-stage rounds (projectile and modular charges) to be loaded, or automatic means allowing only single rounds to be extracted from a magazine. However, when the weapon is in a confined or isolated place, such as on a ship for example, the handling of modular charges and projectiles using conventional means is not conceivable. Indeed, on the one hand the projectile's mass is substantial exceeding the capacities of an operator, and on the other the pyrotechnic risk is unacceptably high since an incident could lead to the destruction of the assembly and thus the potential loss of a ship.

SUMMARY OF THE INVENTION

The aim of the present invention is to provide an automatic loading device for a large or medium caliber weapon mounted in an isolated structure such as a ship and ensuring a high level of safety.

The invention thus relates to a loading device for a medium or large caliber weapon supplied with rounds formed of a projectile and modular charges, wherein it comprises means to receive a projectile and the modular charges, a vehicle incorporating at least two housings, and suitable support means to allow the vehicle to move from an initial replenishing position to a final weapon loading position in which the projectile housing then the modular charge housing are brought successively into said position.

Advantageously, the support means are constituted by a cage having two sides between which the vehicle travels.

Advantageously again, the projectile and modular charge reception means are constituted by a container in the shape of a tubular element fitted with retention means for the projectile and the modular charges.

According to one embodiment, the vehicle is constituted by a slide and a drum in the shape of a substantially parallelepipedic part having housings at its parallel edges intended to each receive a container and the drum can incorporate four housings arranged according to four parallel edges.

The cage delimits the arc of a circle centered on the weapon's trunnion shaft and it comprises a race arranged on each side in which the slide is mounted by means of rollers.

According to another embodiment, the vehicle drum is mounted able to rotate with respect to the slide.

According to yet another embodiment, the vehicle is able to move with respect to the cage by means of a motor integral with the slide meshing with a rack integral with the cage.

The vehicle may support means to introduce the projectile then the charges into the weapon chamber.

The introduction means are represented by a thrustor acting on the projectile and a rammer acting on the modular charges.

The drum incorporates means to lock the containers.

According to yet another embodiment, the transfer means are integral with the turret to firstly transfer the empty containers into a space arranged nearby and secondly to pick up full containers of projectiles and modular charges from this space.

A first advantage of the device according to the invention lies in the high level of safety obtained since the projectiles and the modular charges are never handled. Indeed, during all the handling phases between the projectile and modular charge storage space and their loading into the weapon it is a protection element constituted by the container that withstands all the constraints.

A second advantage lies in the compactness of the loading device which is placed very close to the weapon and which may be integrated into a turret without any major modifications to said turret.

Another advantage lies in the fact that the loading device ensures the process may be reversed in the event of an incident.

BRIEF DESCRIPTION OF THE DRAWINGS

Other characteristics, particulars and advantages of the invention will become more apparent from the description given hereafter in reference to the drawings in which.

DETAILED DESCRIPTION OF PREFERRED EMBODIMENTS

Figure 1:
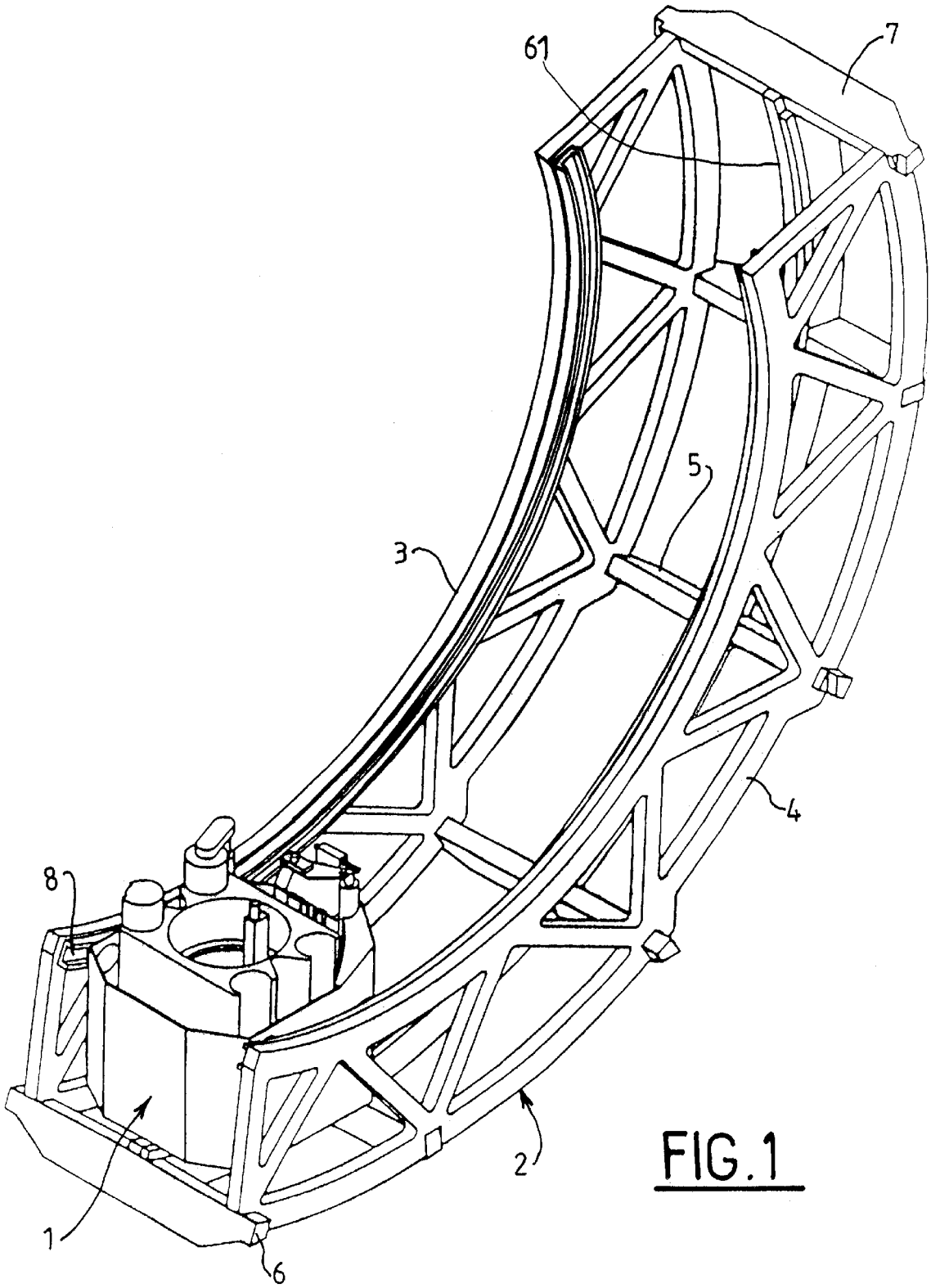
FIG. 1 is a view showing the vehicle and its support.

FIG. 1 shows a view of a vehicle 1 and support means 2 defining in the plane of the figure a starting position at one end and any final position between the starting position and the other end. The vehicle 1 visible on the figure is shown in the starting position and in this position it may be filled with projectiles and modular charges as will be explained hereafter. The support 2 is an open structure comprising two sides 3 and 4 joined by beams 5, fitted at each end with a lower abutment 6 and an upper abutment 7. These abutments limit the range of movement of the vehicle. Each side is provided with a groove. In the Figure, we can see that the groove 8 in side 3 is delimited by a U-shaped angle bracket. The same is true for the groove in side 4. The support means have a preferred shape that is globally that of the arc of a circle and in other words the vehicle moves between its two starting and final positions along the arc of a circle. The vehicle 1 is thus able to move with respect to its support 2 along which it follows the arc of a circle.

Figure 2:
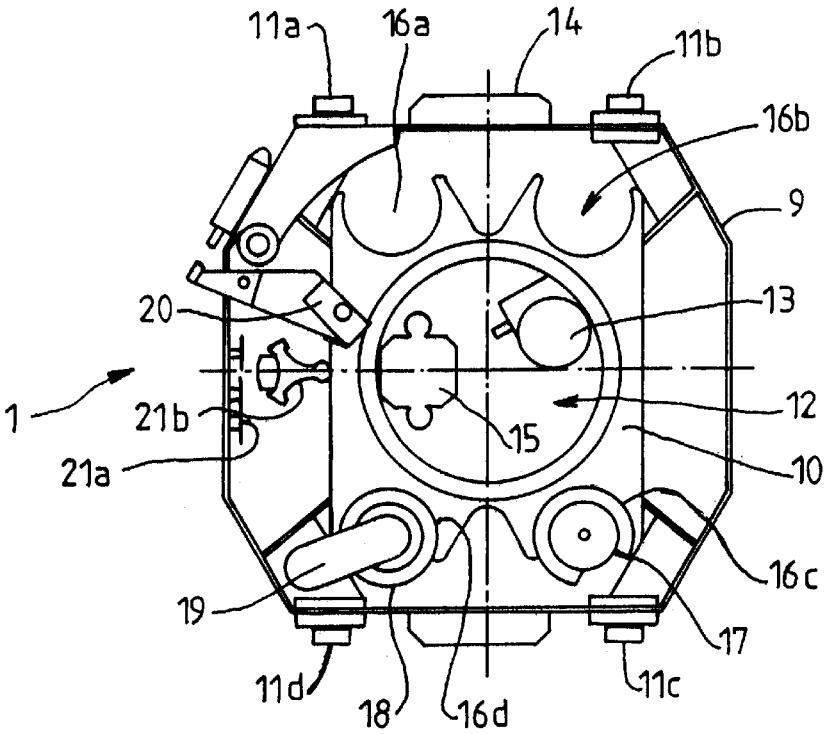
FIG. 2 is a top view of the drum.

FIG. 2 shows a top view of the vehicle 1, that is composed of two parts, a slide 9 and a drum 10. The slide 9 in is the general shape of a closed envelope onto which four external rollers 11*a*–11*c* are fitted which slide in the grooves 8 of the support 2 so as to allow the vehicle to move in the arc of a circle race defined by the grooves 8. The drum 10 is in the globally parallelepipedic in shaped and is provided with a recess 12 in its central part in which a motor 13 is fixed that allows the drum 10 to be driven in rotation with respect to the slide 9 along a perpendicular axis to the plane of the Figure and aligned according to the radius of the arc of a circle. The slide 9 is driven with respect to the support 2 by means of a motor not shown meshed with the rack 61 and guided by rollers 14. A booster 15 is provided in the recess 12 that is intended to act on the projectile as will be explained hereafter. The drum 10 comprises four housings 16*a*–16*d* arranged according to four parallel edges. Two housings 16*a*–16*b* are shown empty in the upper part of the Figure and two housings 16*c*–16*d* are shown full in the lower part of the Figure. The housing 16*c* for example receives a container 17 of charge modules and the housing 16*d* receives a projectile container 18. A timing device 19 is arranged in the vicinity of the container 18 whose function is to time the fuse present on the projectile. A sensor 20 integral with the slide 9 allows any debris from a previous firing to be detected in the cannon before the new loading sequence commences. In the Figure, a rammer 21 is shown whose function is to introduce the charge modules from container 17 into the weapon chamber.

Figure 3:
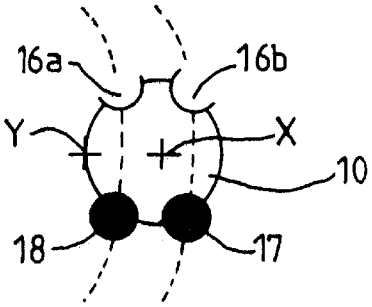
FIG. 3 is a schematic view showing the starting position of the drum shown in FIG. 1.
Figure 4:
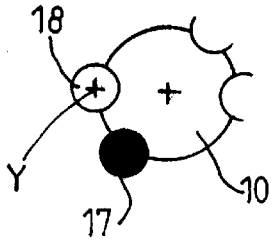
FIG. 4 is a schematic view showing the next position after the starting position of the drum shown in FIG. 1.

FIGS. 3 to 6 show the different phases of rotation of the drum 10 with respect to its axis of rotation X under the action of the motor 13 and with respect to the axis Y of the weapon. In FIG. 3, as in FIG. 2, the drum 10 has two empty housings 16*a* and 16*b* and two housings filled with charge modules in a container 17 and a projectile in container 18. In FIG. 4, the vehicle 1 has been transferred from its starting position to its final weapon loading position. During this phase, the drum 10 is subjected to a rotation of $1/6^{th}$ of a revolution with respect to the slide 9 and the projectile container 18 is placed in the weapon axis Y at the delivery post. The projectile may then be delivered into position in the weapon chamber, the container being retained in the drum by appropriate means. After delivering the projectile and a further $1/6^{th}$ revolution of the drum 10 according to FIG. 5, the modular charges present in container 17 are in the axis Y of the chamber and may be introduced by means of the rammer 21*a* to which the pusher 21*b* is attached, means being provided to retain the container in the drum. After the charge modules have been pushed into place and further to another $1/6^{th}$ revolution according to FIG. 6, the drum 10 is no longer aligned with the axis Y of the cannon and it incorporates two empty housings 16*a*–16*b* and two housings occupied by empty containers 17. The vehicle is then lowered into its starting position. As soon as the drum is supplied with projectile and modular charge containers, the previously described cycle may begin again.

Figure 5:
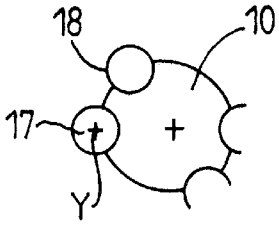
FIG. 5 is a schematic view showing the position prior to the final position of the drum shown in FIG. 1.
Figure 6:
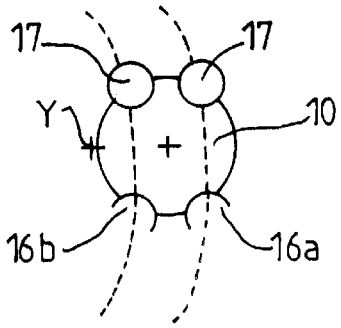
FIG. 6 is a schematic view showing the final position of the drum shown in FIG. 1.
Figure 7:
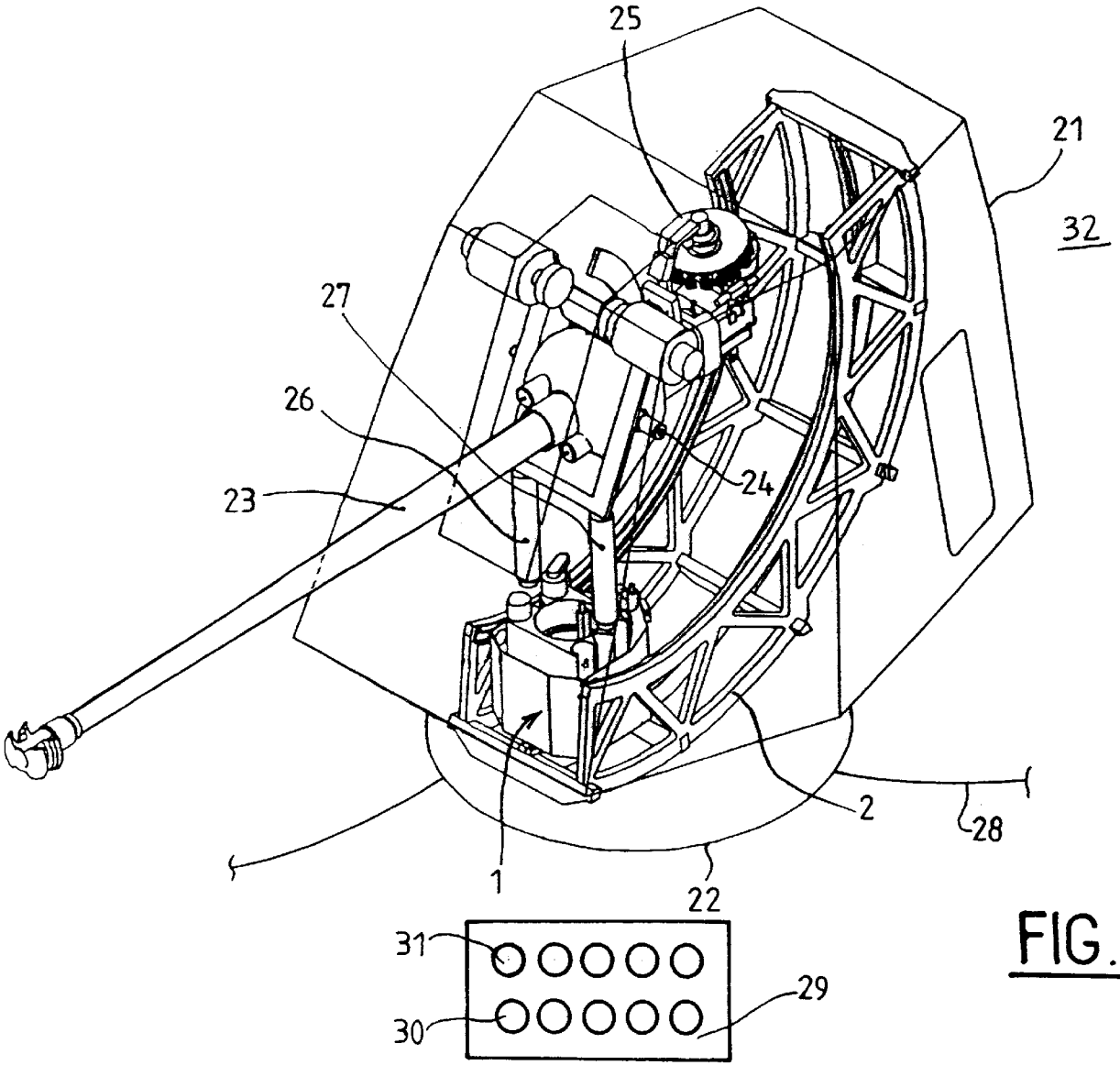
FIG. 7 shows a turret fitted with the device according to the invention.

FIG. 7 allows us to understand the advantage of the device according to the invention. Let's take as an example a turret 32 mobile in traverse following a circuit 22 and supporting a weapon 23 mobile in elevation with respect to trunnions 24 able to rotate with respect to the turret. The weapon is of the 155 mm 52 caliber type and is supplied with projectiles and modular propellant charges. The two stages of the round are brought to the rear of the weapon, using the device according to the invention, into a so-called loading position. This principle is known and does not require further explanation. The vehicle 1 mounted on the support 2 is integrated into the turret and according to an entirely automated sequence brings the two stages of the round up to the weapon chamber to be fired. Firing is carried out conventionally by means of squibs stored in a drum 25 placed in the weapon breech. The vehicle 1 in its lower position co-operates with two actuators 26 and 27, one of which 26, the elevator, intended to pick up a projectile and module container from a storage space 29 located beneath the circuit 22 following a replenishment axis, the other 27, the pusher, intended to introduce the empty containers into the storage space. The turret 32 is then laid in traverse and in elevation according to the firing instructions received. When the weapon breech 23 is open, the vehicle 1 is made to move back towards the rear of the weapon. During its return, the timer means 19 are lowered to cap the fuse of the projectile in place and aligned with the delivery axis. When the fuse is set, the means 19 are released, the drum 10 is then made to rotate with respect to the slide 9 of a $1/6^{th}$ of a revolution to bring the timed projectile into the delivery axis as shown in FIG. 4. In the position in which it is aligned with the delivery axis, the vehicle 1 is locked on the cannon 23 so as to eliminate any relative movement of the vehicle with respect to the weapon. The projectile is unlocked with respect to its container and the pusher 15 is activated to deliver the projectile into position, that is to bring it to the forcing cone in the weapon chamber. An additional rotation of the drum of $1/6^{th}$ of a revolution is made in order to bring the charge modules into the delivery axis Y, as shown in FIG. 5 and after having released the elements retaining the modules in their container the rammer 21 is activated so as to deliver these modules. The drum 10 is made to rotate a further $1/6^{th}$ of a revolution and thus now occupies the position shown in FIG. 6. The slide 9 is then unlocked from the cannon and the vehicle 1 is lowered into its starting position as shown in FIGS. 1 and 3.

It goes without saying that the turret 32 is able to move with respect to its support shown, for example, by a wall 28 in which the circuit 22 is made. Beneath this wall, for example, storage space 29 is provided for a quantity of projectiles and modular charges that is sufficient for the mission commanded. Naturally, the storage space 29 is positioned so that the actuators 26 and 27 are able to return the empty containers and pick up full ones from this space. Thus, a space 29 comprising empty housings 30 in which the empty containers are introduced and full housings 31 from which the containers are taken may be provided. A storage space comprising a rectilinear alignment of housings is shown. This illustration is given merely by way of example and an alignment in the form of two concentric circles may also be provided.

What is claimed is:

1. A loading device for a medium or large caliber weapon for using at least one round comprising a projectile and modular charges, the loading device comprising:

reception means for receiving said projectile and modular charges;

a vehicle comprising a first housing for receiving a projectile and a second housing for receiving modular charges, said first and second housings for cooperation with said reception means, for receiving and storing said projectile and modular charges;

and support means for moving said vehicle from an initial replenishing position located separate from said weapon to a final weapon loading position for successively moving said projectile housing and then said modular charges housing into said final weapon loading position.

2. A loading device according to claim 1, wherein said support means comprises a cage having two sides for said vehicle to travel therebetween.

3. A loading device according to claim 1, wherein said reception means for receiving said projectile and charge modules comprises a tubular shaped container fitted with retention means for retaining said projectile and the modular charges.

4. A loading device according to claim 3, wherein said vehicle comprises a slide and a substantially parallelepipedic shaped drum having parallel edges and comprising a housing located at each of said parallel edges for receiving a container.

5. A loading device according to claim 4, wherein said drum comprises four housings arranged according to four parallel edges.

6. A loading device according to claim 2, wherein the weapon further comprises a trunnion shaft, wherein said cage delimits an arc of a circle centered on said trunnion shaft.

7. A loading device according to claim 6, wherein said cage comprises rollers and two opposing sides each having a race arranged thereon for mounting said vehicle by means of the rollers.

8. A loading device according to claim 4, wherein said drum is mounted for rotation with respect to said slide.

9. A loading device according to claim 7, further comprising a rack integral with said cage and a motor integral with said slide and rotatably meshing with the rack for moving said vehicle with respect to the cage.

10. A loading device according to claim 1, wherein said weapon comprises a weapon chamber and said vehicle comprises introduction means for introducing said projectile and said charges into the weapon chamber.

11. A loading device according to claim 10, wherein the introduction means comprise a booster for moving said projectile and a rammer for moving said modular charges.

12. A loading device according to claim 4, wherein said drum comprises locking means for locking said containers.

13. A loading device according to claim 1, further comprising container transfer means for moving containers, wherein said transfer means are integral with said turret, said transfer means are for transferring empty containers to a storage space located at a predetermined safe distance from the weapon and for retrieving full containers of said projectiles and modular charges from said space.

* * * * *